US005547546A

United States Patent [19]

Prough et al.

[11] Patent Number: 5,547,546

[45] Date of Patent: Aug. 20, 1996

[54] CHIP BIN WITH STEAMING CONTROL AND A GAS VENT CONTAINING A VACUUM AND PRESSURE RELIEF DEVICE

[75] Inventors: J. Robert Prough; Joseph R. Phillips, both of Queensbury, N.Y.

[73] Assignee: Ahlstrom Machinery Inc., Glens Falls, N.Y.

[21] Appl. No.: 317,801

[22] Filed: Oct. 4, 1994

[51] Int. Cl.[6] ..... D21C 7/12

[52] U.S. Cl. ..... 162/238; 162/246; 162/250; 34/487; 34/491; 222/146.4

[58] Field of Search ..... 162/52, 246, 250, 162/252, 238, 61; 34/482, 487, 484, 485, 491, 524; 138/45, 46; 222/146.4

[56] References Cited

U.S. PATENT DOCUMENTS

| | | | |
|---|---|---|---|
| 4,124,440 | 11/1978 | Sherman | 162/246 |
| 4,221,632 | 9/1980 | Loe, Jr. | 162/49 |
| 5,169,498 | 12/1992 | Weston et al. | 162/246 |

FOREIGN PATENT DOCUMENTS

| | | |
|---|---|---|
| 11546622 | 4/1983 | Canada . |
| 1146788 | 5/1983 | Canada . |

OTHER PUBLICATIONS

Lavigne, John "Instrumentation Applications . . . Paper Industry", 1979, Miller Freeman Publications, pp. 244–254.

*Primary Examiner*—Donald E. Czaja

*Assistant Examiner*—Dean T. Nguyen

*Attorney, Agent, or Firm*—Nixon & Vanderhye P.C.

[57] ABSTRACT

A chip bin for wood chips in a continuous digester system includes internal steaming that is controlled in response to both the interior temperature across the level of chips in the bin, and the level of chips in the bin, so as to substantially prevent cool, non-condensible gas-laden chips from accumulating at the top of the chip column in the bin, and to substantially prevent steam blow-through. The temperature probe used in the chip bin has a temperature sensing portion with a length of about ten to twenty feet instead of the conventional five foot length, and extends across the level of the chips to a position about five feet below the level of chips. Control of steam added to the bin is provided utilizing a controller which controls the position of one or more valves in one or more steam conduits, each valve having multiple open positions and a closed position. A vacuum and pressure relief device is disposed in a non-condensible gases vent from the bin which minimizes the potential for gross gas flow variations across it. The relief device includes a solid interior peripheral portion of the vent, a gate mounted for pivotal movement by a pivot shaft, and a casing which is a cylindrical sector (having a sector angle of about 30°–60°) in which the gate pivots. The casing is mounted in the solid interior peripheral portion and a brush seal is provided between the gate and the cylindrical sector casing.

18 Claims, 3 Drawing Sheets

CHIP BIN WITH STEAMING CONTROL AND A GAS VENT CONTAINING A VACUUM AND PRESSURE RELIEF DEVICE

BACKGROUND AND SUMMARY OF THE INVENTION

Increased concern for the prevention of the release of gaseous by-products of the kraft pulping process has focused attention upon the control of gaseous emissions. The kraft process produces such gases as hydrogen sulfide ($H_2S$), methyl mercaptan ($CH_3SH$), dimethyl sulfide ($CH_3SCH_3$) and dimethyl disulfide ($CH_3SSCH_e$)—collectively known as Total Reduced Sulfur (TRS) gases. These gases are corrosive, toxic and explosive under certain conditions. Care must be taken in their collection, transport and destruction. In a kraft pulp mill, the collection, transportation and destruction system that treats these gases is known as the non-condensible gas (NCG) system.

One source of low-concentration, high-volume NCG's is the chip bin of a continuous digester. Chips fed to a continuous digester are typically first exposed to steam to remove air. In a typical Kamyr® atmospheric chip steaming system, as sold by Kamyr, Inc. of Glens Falls, N.Y., fresh steam and steam produced in the flashing of black liquor are used as a source of steam in both the steaming vessel and chip bin. Since some of this steam is produced from flashed black liquor it typically contains TRS gases.

Ideally, the steam introduced at the base of the chip bin, or which leaks past the low pressure feeder below, rises in the chip column and gradually cools and condenses within the chip column. However, under certain conditions the steam does not condense but passes through the chip column and collects in the enclosed space above the column. Due to the potential corrosivity, toxicity and flammability of these gases they must be removed and, typically, condensed and incinerated, using a typical NCG gas outlet to the condenser. The gases are typically drawn to the condenser by a fan. Also, the presence or absence of these gases above the chips causes the pressure within the bin to fluctuate. Therefore, means must also be provided to prevent the over pressurization of the bin or collapse due to vacuum.

The chip bin typically includes steam introduction piping, an oscillating discharge, a gamma radiation level control, and a temperature probe. The temperature probe is an RTD-type averaging temperature sensor that is rigidly suspended approximately along the centerline of the chip bin. Conventionally, the temperature is only sensed and averaged along a five-foot length at the end of the probe. The remainder of the probe length is for wiring and support. The location of this sensing section varies from bin to bin and its location is dependent upon the production rate and retention time required.

The temperature measured by the temperature sensing probe sensing portion is used to control the addition of steam to the bin, by controlling a multiple position (e.g. infinitely variable) valve. Typically, the temperature measured by the probe is controlled to around 180°–190° F. (82°–88° C.). If the temperature falls below the setpoint, more steam is added; if above, steam flow is reduced.

A vacuum and pressure relief outlet is provided in the vent for NCG. This outlet typically includes the relief device disclosed in U.S. Pat. No. 5,169,498. This device uses a gate which allows for the controlled relief of overpressure and vacuum conditions to prevent damage to the bin. Though this gate is an effective relief device, under some conditions the design of this gate permits gross variation in gas flow through the gate. The bin usually operates under a vacuum condition, typically 6" of water vacuum, due to the draw of the NCG exhaust fan. The counterweights on the '498 patent gate are typically set so that at 6" of vacuum the gate is stationary in the closed, vertical position. However, deviation more or less from the vertical can result in a large increase in flow area about the gate. This may result in undesirable gross variations in the gas flow to the NCG system.

According to the present invention a method of steaming wood chips in a chip bin is provided, as well as a chip bin construction, that overcome the problems discussed above. In particular according to the present invention it is possible to substantially prevent cool, non-condensible gas-laden chips from accumulating at the top of the chip column, which can overload the NCG system, as well as preventing steam blow through (in which steam passes completely through the chip column into the NCG system). According to the invention it is also possible to provide a vacuum pressure relief device which minimizes the potential for gross gas flow variations thereacross as compared to conventional systems such as shown in U.S. Pat. No. 5,169,498.

According to a first aspect of the present invention, the steam addition to the chip bin is controlled as a function of both chip temperature and chip level. To practice this aspect of the invention a temperature probe is utilized with a longer averaging temperature sensing area. The temperature sensing portion of the probe extends across the working level of the chip column. This longer sensing area permits a more accurate measurement of the average chip pile temperature as the level varies. Conventional chip levels may vary by ten to fifteen feet. Ideally, it is desired that steam condense about five feet below the surface of the chip pile, thus the sensing area of the probe need only be long enough to sense to five feet below the surface. However, the sensing area of the temperature probe may be as long as the typical level variation of the chips, i.e., ten to fifteen feet.

According to one aspect of the present invention a method of steaming comminuted cellulose material in a chip bin having a top and bottom, a cellulose material inlet at the top, material outlet at the bottom, an interior temperature sensor, a non-condensible gas vent from the top, and a material level sensor, is provided. The method comprises the steps off (a) Feeding comminuted cellulose material into the material inlet to establish a column of material in the chip bin, having a level below the top of the chip bin. (b) Withdrawing steamed cellulose material from the material outlet, from the bottom of the column of material established in the chip bin. (c) Sensing the interior temperature of the chip bin across the level of the material, and the level of cellulose material column within the chip bin. (d) Venting non-condensible gases through the non-condensible gas vent. (e) Feeding steam to the chip bin below the level of the cellulose material column to steam cellulose material in the column. And, (f) controlling the feeding of steam in step (e) dependent upon both the sensed interior temperature and level of material so as to substantially prevent cool, non-condensible gas-laden chips from accumulating at the top of the column and to substantially prevent steam blow-through.

Step (f) is typically practiced by utilizing a formula which takes into account both the temperature and the level of the chips. While a number of different formulas can be used based upon different assumptions, and depending upon different requirements, a particular formula that is useful according to the invention is:

$$Tsp = Tv + (100 - Tv)\frac{L}{100} \cdot K$$

Where

Tsp is the temperature setpoint for steam addition, in degrees Celsius;

Tv is the desired temperature of non-condensible gases in the vent, and is specified as some increment over ambient temperature, in degrees Celsius;

L is the chip bin level in percent (%); and

K is an arbitrary calibration constant with a typical value between 0.8 and 0.99, which prevents control instabilities should the level, L, reach 100%, so as to add steam whenever the temperature sensed in step (c) is below Tsp.

Step (f) may be further practiced so that Tv is about 5°–20° C. above ambient temperature, the increment over ambient temperature utilized typically varying in dependence upon the species of cellulose material added in step (a), the season of the year, and other factors.

Step (c) is typically practiced utilizing a temperature sensing probe extending from the top of the chip bin into the material column and having a temperature sensing portion length of about ten-twenty (preferably ten to fifteen) feet, and having a bottommost portion that extends about five feet below the expected level of material in the column.

According to another aspect of the present invention a chip bin is provided which comprises the following elements: A generally vertical vessel having a top and a bottom. A cellulose material inlet at the top for feeding cellulose material into the vessel to establish a column of comminuted cellulose material therein, the column having a level. A material outlet at the bottom. An interior temperature sensor comprising a probe extending from the vessel top into the vessel and across the cellulose material column level, and having a temperature sensing portion. A non-condensible gas vent from the vessel top. A material level sensor. Means for feeding steam into the vessel below the level of the cellulose material column to steam cellulose material in the column. And, means for controlling the steam feeding means dependent upon both the sensed temperature from the interior temperature sensor and the sensed level of material from the material level sensor so as to substantially prevent cool, non-condensible gas-laden chips from accumulating at the top of the column and to substantially prevent steam blow-through.

The temperature probe temperature sensing portion typically has a length of at least ten feet, e.g., about ten-twenty feet, and may be an RTD-type. The material level sensor typically comprises, as is conventional, a gamma detector. The steam feeding controlling means typically comprises one or more steam conduits each having a valve therein. The valves are typically infinitely variable position valves, and at least have multiple open positions and a closed position. A controller also controls the position of each of the valves as part of the steam feeding controlling means.

According to the invention a vacuum and pressure relief device is also preferably disposed in a non-condensible gases vent. According to the present invention the vacuum and pressure relief device comprises means for minimizing the potential for gross gas flow variations thereacross, compared to the device such as shown in U.S. Pat. No. 5,169,498.

The vacuum and pressure relief device according to the invention typically comprises the following components: A solid interior peripheral portion of the vent. A gate mounted for pivotal movement with respect to the solid interior peripheral portion by a pivot shaft at a first end of the gate, the gate having a second, free, end opposite the first end. And a casing comprising a sector of a cylinder and having a closed curved exterior surface and closed first and second ends and open first and second sides, the cylindrical sector casing mounted in the solid interior peripheral portion so that the open sides thereof communicate with the vent and so that the casing surrounds the gate between the first and second ends thereof, the gate pivotal about the pivot shaft with respect to the casing.

Also a brush or similar type seal is preferably provided between the gate and at least the closed first and second ends of the cylindrical sector casing (the seal may also be provided along the closed curved interior surface of the casing). The seal may be mounted on the casing or the gate or both. Also a counterweight is preferably mounted on the pivot shaft, generally in the same manner as shown in U.S. Pat. No. 5,169,498 (the disclosure of which is hereby incorporated by reference herein).

The cylindrical sector has a sector angle of about 30°–60° so that the curved exterior surface also extends about 30°–60°, preferably about 45°. By providing the casing covering this degree of arc, rather than merely providing a narrow closure area for the gate such as shown in U.S. Pat. No. 5,169,498, gross variations in the gas flow to the NCG system may be minimized.

It is the primary object of the present invention to provide a chip bin, and method of steaming chips in the chip bin, which prevents overload of an NCG system so as to minimize the emission of TRS gases. This and other objects of the invention will become clear from an inspection of the detailed description of the invention, and from the appended claims.

DETAILED DESCRIPTION OF THE DRAWINGS

Figure 1:
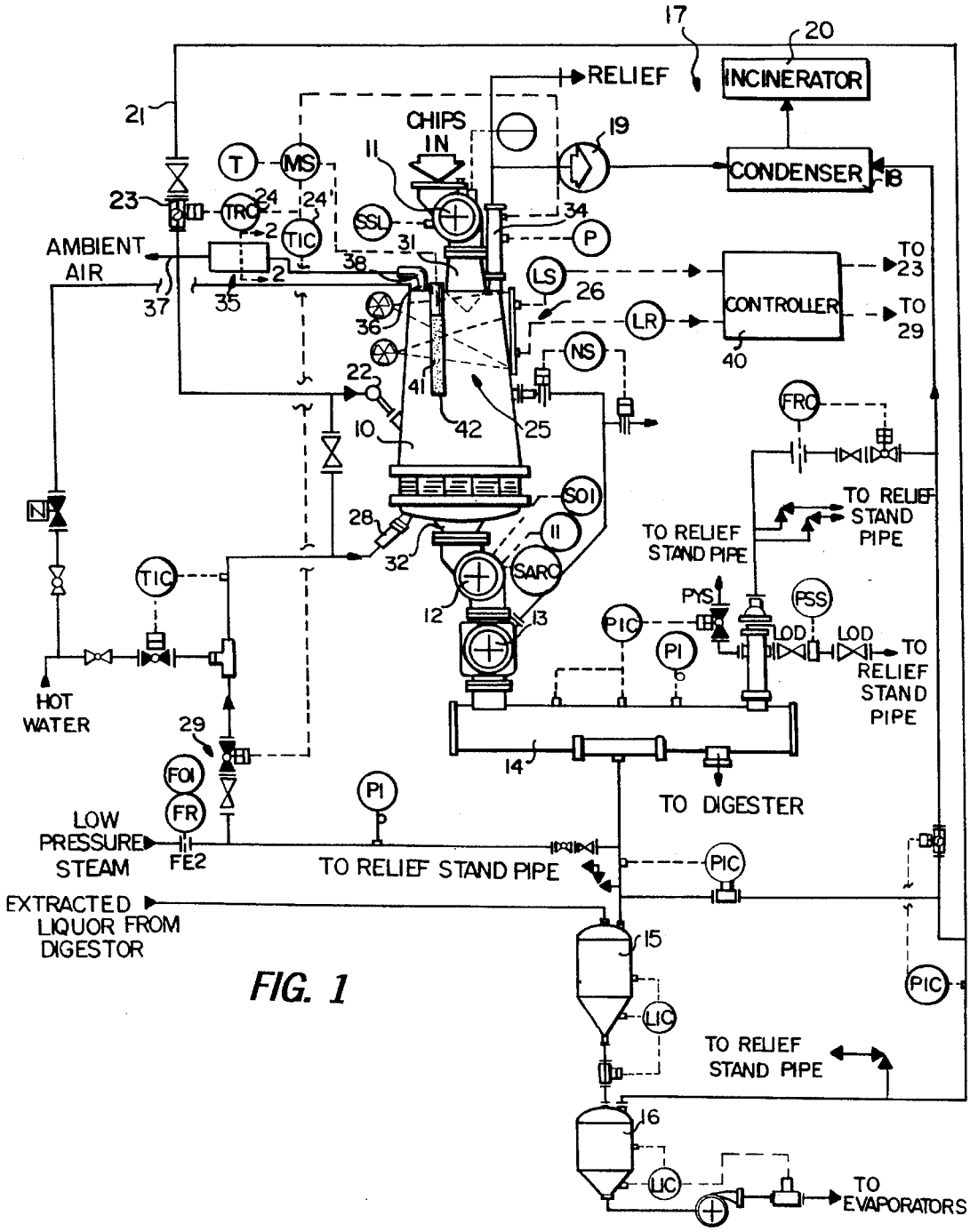
FIG. 1 is a schematic view showing an exemplary chip bin and associated feeding and steaming structures, according to the present invention.

An exemplary atmospheric chip steaming system for use with Kamyr® or like continuous digesters for the production of kraft pulp is shown schematically in FIG. 1. Most of the components of the system of FIG. 1 are conventional including the chip bin 10 per se, and the air lock 11, chip meter 12, low pressure feeder 13, horizontal steaming vessel 14, flash tanks 15, 16, NCG system shown generally by reference numeral 17 and including condenser 18, fan 19 and incinerator 20, and the majority of the steam, liquid, and supply lines, valves, sensors, and controls. In particular note the line 21 which adds steam to the chip bin 10 through a conventional header 22, the amount of steam being added being controlled by an infinitely variable valve 23 controlled by a temperature controller 24 associated with an RTD-type temperature probe shown generally by reference numeral 25. A level sensor, typically of the gamma detector type, is also provided and shown schematically by reference numeral 26. Note that the steam in the line 21 comes from the flash tank 16 which is provided with black liquor from the digester, and therefore the steam in line 21 typically will have TRS gases therein. Steam is also added through the conventional supporting arms and vibrating cones via conduit 28, which includes an infinitely-variable positioned valve 29 therein also controlled by temperature controller 24'.

Other conventional components of the chip bin 10 include the chip inlet 31 at the top of the chip bin 10, and chip outlet 32 at the bottom. The outlet 32 is typically below the Vibra-Bin® discharge and is connected to the chip meter 12, while the inlet 31 is fed chips through the air lock 11. A vent 34 for non-condensible gases also extends upwardly from the top of the chip bin 10, being connected to the NCG system 17. A second conduit system is also provided, shown generally by reference numeral 35, which provides vacuum/pressure relief, such as shown generally in U.S. Pat. No. 5,169,498. While the vacuum/pressure relief conduit system 35 is shown schematically in FIG. 1 as separate from the vent pipe 34 of the NCG system 17, under some circumstances it may instead be operatively connected to vent pipe 34. In the exemplary embodiment illustrated, the conduit system 35 includes a generally-vertical conduit 36 and a generally-horizontal conduit 37 which opens up to the atmosphere, with an elbow 38 therebetween. This arrangement is illustrated more clearly in FIGS. 2 through 4.

What is different, according to the present invention, about the system illustrated in FIG. 1 are the details of the temperature probe 25, and the fact that the level detector 26 is used—in association with a controller, such as a controller shown schematically at 40 in FIG. 1—to control (along with temperature, as is conventional) supply of steam to the chip bin 10, e.g., through header 22 and/or conical discharge support arms supplying conduit 28. While control is shown associated with respect to header 22 and conduit 28, which are parts of conventional steam supply (as shown in U.S. Pat. No. 4,124,440 and Canadian Patents Nos. 1,154,622 and 1,146,788), the control can be associated with any steam feeding means. Also, the particular vacuum and pressure relief device, shown generally by reference numeral 35 in FIG. 1, is different according to the present invention, and as shown in detail in FIGS. 2 through 4.

The setpoint for controlling the addition of steam beneath the chip column, according to the invention, in chip bin 10 is calculated as a function of the chip level, as indicated by the gamma radiation detection, and a specified gas exhaust or vent temperature. The desired NCG vent temperature is determined by specifying a desired temperature increase over ambient temperature. The setpoint calculation can be given by the following expression:

$$Tsp = Tv + (100 - Tv)\frac{L}{100} \cdot K \tag{1}$$

Where

Tsp is the temperature setpoint for steam addition, in degrees Celsius;

Tv is the desired temperature of non-condensible gases in the vent, and is specified as some increment over ambient temperature, in degrees Celsius;

L is the chip bin level in percent (%); and

K is an arbitrary calibration constant with a typical value between 0.8 and 0.99, which prevents control instabilities should the level, L, reach 100%. Using such an expression, or a similar one, the setpoint for steam addition can be calculated as a function of chip level.

For example, given an ambient temperature of 20° C. (i.e., 68° F.), a typical increase over ambient for the desired vent temperature would be 10° C. (e.g. about 5°–20° C.), such that $$Tv = T\infty + \Delta T \text{ or}$$

$$Tv = 20°\text{ C.} + 10°\text{ C.} = 30°\text{ C.} \tag{2}$$

The value of ΔT will vary depending upon the season, wood species, etc. Substituting the value in equation (2) into equation (1), and assuming a value of K of 0.9, yields the expression $$Tsp = 30 + (100 - 30) \cdot (0.9)\frac{L}{100}\ °\text{C.} \tag{3}$$

or $$Tsp = 30 + 63\frac{(L)}{100}\ °\text{C.}$$

Therefore, for a level of 50%, the steam addition setpoint will be 61.5° C. For a 0% level the setpoint is 30° C. and for a level of 100%, 93.0° C. Thus, more steam will be added as the level rises and less as the level drops. This prevents excess steam addition at any chip level which can result in "blow-through" of steam and an erratic loading of the NCG system 17. This also ensures that sufficient steam is added as the level rises so that cool, NCG laden chips do not accumulate at the top of the chip column. As noted previously, the sudden release of the NCG's can overload the NCG system 17.

While the mathematical expressions set forth above define preferred expressions, it should be noted that other mathematical expressions, based upon different assumptions, may also be formulated, as long as they utilize both temperature and chip level to control the addition of steam to substantially prevent cool, non-condensible gas-laden chips from accumulating at the top of the column, and to prevent steam blow-through. Note that in the exemplary embodiment illustrated in FIG. 1, the controller 40 connected to the level detector 26 controls the valves 23, 29 in conjunction with the conventional controllers 24, 24'. The controllers 40, 24, 24' may all be part of the same actual physical structure.

The temperature probe 25 according to the present invention is different from conventional temperature probes in that instead of the temperature sensing portion 41 thereof being only about five feet long, it is at least 10 feet long, and preferably about ten to twenty (e.g., ten to fifteen) feet long. As is conventional, the probe 25 is mounted at the top of chip bin 10 and extends downwardly into the chip bin 10. The longer sensing area permits more accurate measurement of the average chip column temperature as the level varies. Conventional chip levels may vary by ten to fifteen feet. Ideally, it is desired that the steam condense about five feet below the surface of the chip column, thus the sensing area 41 of the probe 25 (the bottom-most portion 42 thereof) need only be long enough to sense to about five feet below the level (top) of the chips in the chip column. Since the probe 25 goes across the level of the chip column sensing area, it should be as long as the typical level variation of the chips, that is about ten to fifteen feet.

Note that the level sensor 26 of the system of FIG. 1 continues to perform its conventional function of ensuring that the level of chips in the bin 10 is substantially constant, by controlling the introduction of chips through the air lock 11. Also, while the method and apparatus have been described above with respect to wood chips, it is to be understood that wood chips are only exemplary and other comminuted materials or particulates that require steaming may also be utilized.

The improved vacuum and pressure relief device according to the present invention will now be described with respect to FIGS. 2 through 4. The vacuum and pressure relief device according to the present invention is shown generally by reference numeral 45 in FIGS. 2 and 3 in association with the general system 35, and typically disposed in the generally-horizontally extending conduit portion 37 thereof.

Figure 2:
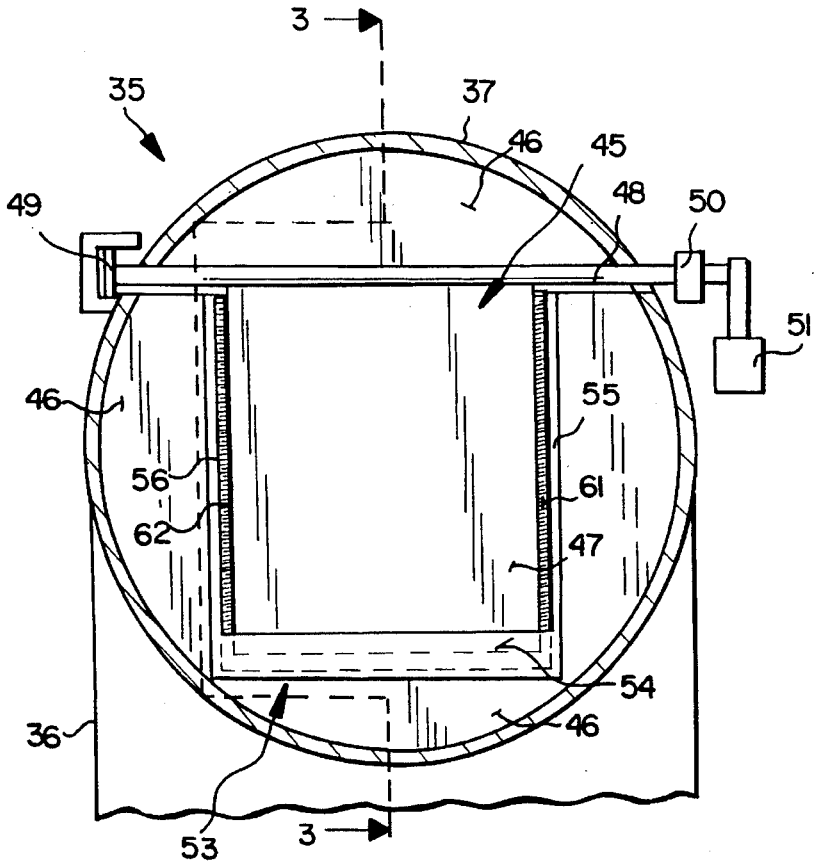
FIG. 2 is an end/cross-sectional view of the NCG vent of the system of FIG. 1 taken along lines 2—2 thereof.
Figure 3:
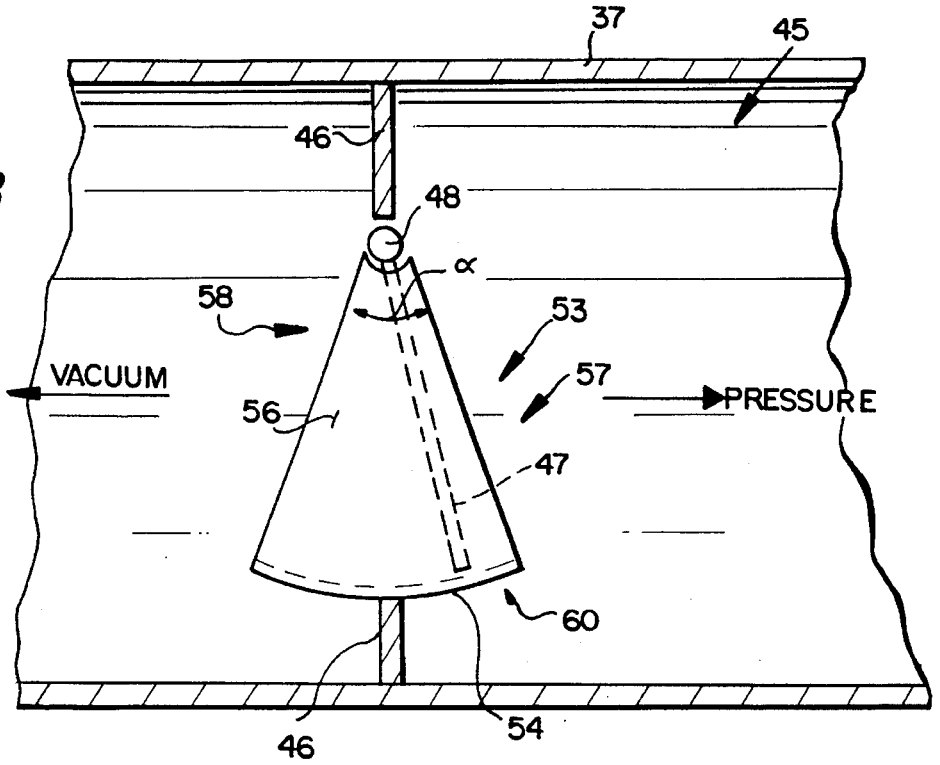
FIG. 3 is a side view, partly in cross-section and partly in elevation, of the vacuum and pressure relief device of FIG. 2, taken along lines 3—3 thereof.

The device 45 includes a solid interior peripheral portion 46 disposed within the vent, that is in FIGS. 2 and 3 within the conduit portion 37 thereof. Solid material peripheral portion 46 preferably is a metal plate. It defines an interior opening in which a gate 47 is mounted for pivotal movement about a pivot shaft 48. As seen in FIG. 2 the shaft 48 is typically mounted by bearings 49, 50 adjacent the ends thereof, and as shown in U.S. Pat. No. 5,169,498 a counterweight 51 may be mounted on the pivot shaft 48 to bias the gate 47 to desired position.

In the device 45 according to the present invention, in order to minimize the potential for gross gas flow variations thereacross, a casing 53 is provided surrounding gate 47 within the conduit/vent 37. The casing 53 is in the form of a sector of a cylinder having a closed curved exterior surface 54 and closed first and second end 55, 56 the casing 53 also has open sides shown generally by reference numeral 57, 58 in FIG. 3, the open side 57 communicating with the atmosphere in case the pressure build-up in the chip bin 10 is too high, while the side 58 communicates with the interior of the chip bin 10 and the NCG system in case too high of a vacuum condition occurs in the chip bin 10. In the embodiment illustrated in FIGS. 2 and 3, the zero setting for the gate 47 (as provided by adjustment of the counterweight 51) is preferably as indicated by arrow 60 in FIG. 3.

It is preferred that the cylindrical sector of the casing 53 has a sector angle α (see FIG. 3) of between about 30° and 60°, preferably about 45°. This means, of course, that the curved exterior surface 54 has that same angle (between about 30°–60°).

If desired, some sort of a sealing mechanism can be provided between the gate 47 and the casing 53. For example, a brush (or similar) seal, shown by reference numerals 61 and 62 in FIG. 2, is provided comprising a strip of resilient brush-like material disposed along each of the side edges of the gate 47 adjacent the closed sides 55, 56 of the casing 53. The brush seal portions 61, 62 tightly engage the interior portions of the closed sides 55, 56 to prevent gas flow therepast. If desired, a similar seal may be provided on the bottom edge of the gate 47, or the brush seal may be provided on the interior of the casing 53 instead of the gate 47, or in addition to the brush seal on the gate 47.

Figure 4:
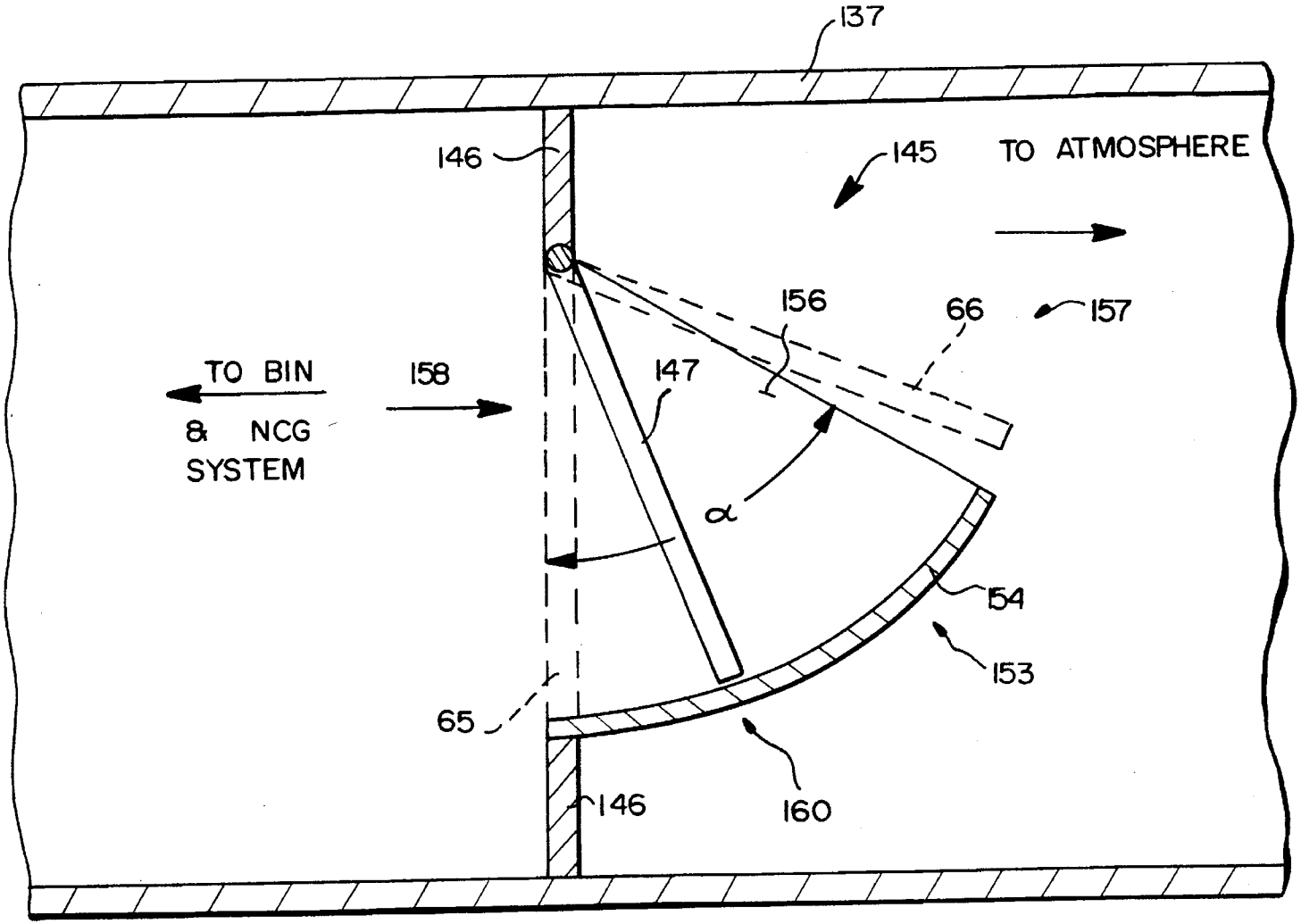
FIG. 4 is a view like that of FIG. 3 for a slightly different embodiment and showing the casing in cross-section but the gate in elevation, with the preset position of the gate in solid line and with other positions thereof in dotted line.

FIG. 4 illustrates a slightly different embodiment of the vacuum and pressure relief device according to the present invention. In FIG. 4 components seen as those in the FIGS. 2 and 3 embodiment are shown by the same reference numeral only preceded by a "1".

The major difference between the embodiment of FIG. 4 and that of FIGS. 2 and 3 is the positioning of the casing 153 with respect to the solid interior peripheral portion 146. In this embodiment the portion of the casing 153 closest to the end 158 is mounted essentially flush with the plate which comprises the solid portion 146.

FIG. 4 also illustrates the various positions of the gate 147 depending upon the conditions existing in the chip bin 10. The solid line position of the gate 147 in FIG. 4 corresponds to a six inch vacuum preset (desired "0") setting position. The position illustrated in dotted line at 65 in FIG. 4 is a typical eight inch vacuum position and if the vacuum is any higher than that the air from the atmosphere will pass past the gate 147 to flow to the bin 10 and the NCG system 17. The dotted line position illustrated at 66 in FIG. 4 is the over-pressure relief position. In that position, gas flows past the gate 147 to the atmosphere, relieving an over-pressure condition in the chip bin 10.

Because the gate 147 provides a sealing action for the entire arcuate extent of angle α (about 30°–60°), rather than merely at the position of the plate 146, the potential for gross gas flow variations across the gate 147 is minimized, and therefore the load on the NCG system 17 will be more consistent.

It will thus be seen that according to the present invention, a method and apparatus are provided which will result in minimal release of TRS gases from a chip bin in a kraft pulping system. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and devices.

What is claimed is:

1. A chip bin comprising:

a generally vertical vessel having a top and a bottom;

a cellulose material inlet at said top for feeding cellulose material into said vessel to establish a column of comminuted cellulose material therein;

a material outlet at said bottom;

a non-condensible gas vent from said top;

a vacuum and pressure relief device disposed in said non-condensible gas vent, said vacuum and pressure relief device comprising: a solid interior peripheral portion of said vent; a gate mounted for pivotal movement with respect to said solid interior peripheral portion by a pivot shaft at a first end of said gate, said gate having a second, free, end opposite said first end; and a casing comprising a sector of a cylinder and having a closed curved exterior surface and closed first and second ends and open first and second sides, said cylindrical sector casing mounted in said solid interior peripheral portion so that said open sides thereof communicate with said vent and so that said casing surrounds said gate between said first and second ends thereof, said gate being pivotal about said pivot shaft with respect to said casing;

a seal between said gate and at least said closed first and second ends of said cylindrical sector casing; and wherein said cylindrical sector casing has a sector angle of between about thirty-sixty degrees, so that said curved exterior surface extends between about thirty sixty degrees; and a counterweight mounted on said pivot shaft.

2. A chip bin as recited in claim 1 wherein said casing surrounds said gate at a portion thereof approximately midway between said first and second ends thereof.

3. A chip bin as recited in claim 2 wherein said cylindrical sector casing has a sector angle of about forty-five degrees so that said curved exterior surface extends about forty-five degrees.

4. A chip bin as recited in claim 1 wherein said casing surrounds said gate approximately at one of said first and second ends thereof.

5. A chip bin as recited in claim 1 wherein said cylindrical sector casing has a sector angle of about forty-five degrees so that said curved exterior surface extends about forty-five degrees.

6. A chip bin comprising:

a generally vertical vessel having a top and a bottom;

a cellulose material inlet at said top for feeding cellulose material into said vessel to establish a column of comminuted cellulose material therein, having a level;

a material outlet at said bottom;

an interior temperature sensor comprising a probe extending from said vessel top into said vessel go as to extend across the cellulose material column level, and having a temperature sensing portion;

a non-condensible gas vent from said vessel top;

a material level sensor positioned and arranged to sense the level of the cellulose material;

means for feeding steam into said vessel below the level of the cellulose material column to steam cellulose material in the column;

means for controlling said steam feeding means dependent upon both the sensed temperature from said interior temperature sensor and the sensed level of material from said material level sensor so as to substantially prevent cool, non-condensible gas-laden chips from accumulating at the top of the column and to substantially prevent steam blow-through;

a vacuum and pressure relief device disposed in said non-condensible gas vent, said vacuum and pressure relief device comprising means for minimizing the potential for gross gas flow variations thereacross; and wherein said means for minimizing the potential for gross gas flow variations across said vacuum and pressure relief device comprises a solid interior peripheral portion of said vent; a gate mounted for pivotal movement with respect to said solid interior peripheral portion by a pivot shaft at a first end of said gate, said gate having a second, free, end opposite said first end; and a casing comprising a sector of a cylinder and having a closed curved exterior surface and closed first and second ends and open first and second sides, said cylindrical sector casing mounted in said solid interior peripheral portion so that said open sides thereof communicate with said vent and so that said casing surrounds said gate between said first and second ends thereof, said gate being pivotal about said pivot shaft with respect to said casing.

7. A chip bin as recited in claim 6 wherein said temperature probe temperature sensing portion has a length of at least ten feet.

8. A chip bin as recited in claim 6 wherein said steam feeding controlling means comprises one or more steam conduits each having a multiple open positions and closed position valve therein, and a controller for controlling the position of each of said valves.

9. A chip bin as recited in claim 6 wherein said material level sensor comprises a gamma detector.

10. A chip bin as recited in claim 6 wherein said temperature probe temperature sensing portion has a length of about fifteen to twenty feet.

11. A chip bin as recited in claim 10 wherein said material level sensor comprises a gamma detector.

12. A chip bin as recited in claim 6 further comprising a seal between said gate and at least said closed first and second ends of said cylindrical sector casing.

13. A chip bin as recited in claim 12 wherein said cylindrical sector casing has a sector angle of about thirty-sixty degrees, so that said curved exterior surface extends about thirty-sixty degrees; and further comprising a counterweight mounted on said pivot shaft.

14. A chip bin as recited in claim 13 wherein said cylindrical sector casing has a sector angle of about forty-five degrees so that said curved exterior surface extends about forty-five degrees.

15. A chip bin as recited in claim 12 wherein said cylindrical sector casing has a sector angle of between about thirty-sixty degrees, so that said curved exterior surface extends between about thirty-sixty degrees.

16. A chip bin as recited in claim 15 wherein said casing surrounds said gate at a portion thereof approximately midway between said first and second ends thereof.

17. A chip bin as recited in claim 16 wherein said cylindrical sector casing has a sector angle of about forty-five degrees so that said curved exterior surface extends about forty-five degrees.

18. A chip bin as recited in claim 15 wherein said casing surrounds said gate approximately at one of said first and second ends thereof.

* * * * *